US005655693A

United States Patent [19]

Engelman et al.

[11] Patent Number: 5,655,693

[45] Date of Patent: Aug. 12, 1997

[54] CLIP-ON SHOEHORN

[75] Inventors: Ian K. Engelman, Newtown; Roger Hernandez, Oxford, both of Conn.

[73] Assignee: Biometrics, Inc., Trumbull, Conn.

[21] Appl. No.: 740,352

[22] Filed: Nov. 7, 1996

[51] Int. Cl.[6] ..... A47G 25/92

[52] U.S. Cl. ..... 223/119; 223/118

[58] Field of Search ..... 223/118, 119, 223/111, 113, 116

[56] References Cited

U.S. PATENT DOCUMENTS

| | | | |
|---|---|---|---|
| 457,115 | 8/1891 | Gysin | 223/119 |
| 655,417 | 8/1900 | Raudau | 223/119 |
| 3,410,463 | 11/1968 | Carlos | 223/119 |

FOREIGN PATENT DOCUMENTS

| | | | |
|---|---|---|---|
| 63297 | 2/1914 | Austria | 223/118 |
| 457586 | 3/1928 | Germany | 223/118 |
| 95969 | 9/1922 | Switzerland | 223/119 |
| 107848 | 2/1917 | United Kingdom | 223/118 |

*Primary Examiner*—Bibhu Mohanty
*Attorney, Agent, or Firm*—Michael Ebert

[57] ABSTRACT

A clip-on shoehorn making it possible for an individual to slip his foot into a shoe despite a physical disability which impairs his ability to do so with the assistance of a conventional shoehorn. The clip-on shoehorn is provided with a U-curved blade of flexible material whose opposing flanks engage and spread out the sides of the shoe when the blade is inserted therein whereby the blade enlarges the entry to the shoe and serves as a chute for the entering foot. Extending upwardly from the blade is an elongated handle, permitting the individual who grasps the handle to insert the blade into the shoe without having to bend down. Joined to the rear of the blade adjacent its upper end is a clip formed by a pair of superposed flexible strips which when the blade is inserted in the shoe then clamp onto the counter of the shoe to hold the blade in place. Tethered to the upper end of the handle is a clasp which when the blade is inserted in the shoe is then attachable to the tongue of the shoe to keep it away from the entry thereto while the foot is being slipped into the shoe.

7 Claims, 2 Drawing Sheets

FIG. 4
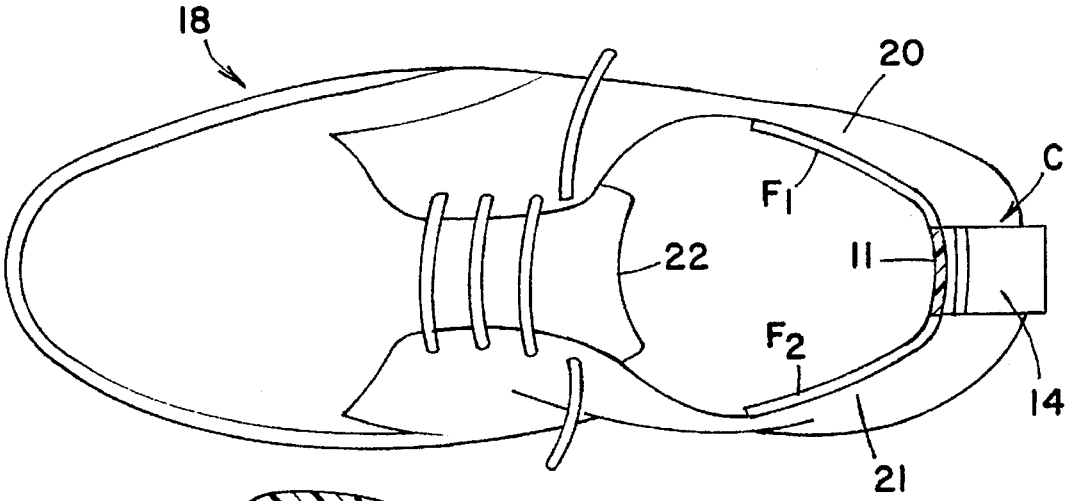
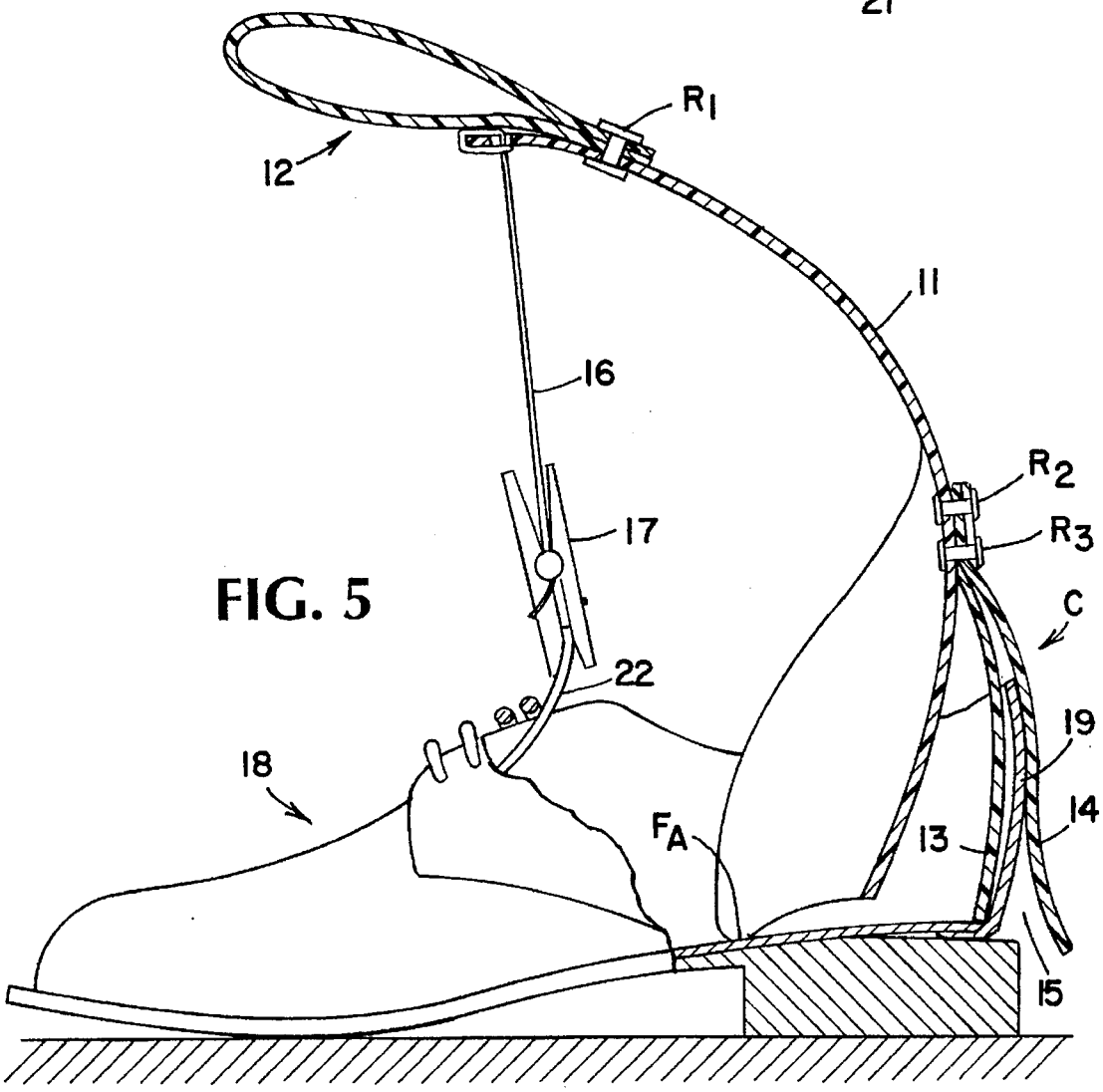
FIG. 5

CLIP-ON SHOEHORN

BACKGROUND OF INVENTION

1. Field of Invention

This invention relates generally to shoehorns to assist an individual in slipping his foot into a shoe, and more particularly to a clip-on shoehorn which makes it easy for an individual to don a shoe despite a physical disability making it difficult for him to do so with a conventional shoehorn.

2. Status of Prior Art

A conventional shoehorn is a smooth, curved implement formed of metal or plastic that is insertable in a shoe to assist the user in slipping his foot therein. A person who is in no way disabled or handicapped, experiences little difficulty in slipping his foot into a shoe when using a conventional shoehorn, even when the shoe is tight fitting.

To use a conventional shoehorn, the usual practice is for the user to sit in a chair with his feet on the floor and with the shoe to be donned placed before one foot. The seated user holding the shoehorn in one hand then bends down to insert the horn in the shoe. And with the other hand the user raises the tongue of the shoe so that it clears the entry to the shoe. The user then enters the shoe with his foot, the foot sliding along the shoehorn to facilitate its entry into the shoe interior. In a shoe, the tongue is a hinged flap positioned under the laces or buckles, and in a vacant shoe, the tongue usually hangs down.

It is not always necessary to use a shoehorn, for if the shoe is somewhat loose and does not exactly fit the foot which goes into it, then the foot can be slipped in without the aid of a shoehorn. But with well-fitting shoes, a shoehorn is usually helpful. However, the seemingly simple task of putting on a shoe presents difficulties to individuals who are enfeebled or in some way handicapped or disabled and therefore find it difficult to bend down. Because of this, these individuals are unable to use a conventional shoehorn.

Hence while an individual who is in fairly good condition experiences little difficulty in using a conventional shoehorn when putting his foot into a shoe, a handicapped individual is often unable to carry out this simple operation without assistance.

SUMMARY OF INVENTION

In view of the foregoing, the main object of the invention is to provide a clip-on shoehorn making it possible for an individual to slip his foot into a shoe despite a physical handicap which impairs his ability to do so with a conventional shoehorn.

More specifically, an object of this invention is to provide a shoehorn whose blade has a clip attached to its rear whereby when the blade is inserted in the shoe, the clip then clamps onto the counter of the shoe to hold the blade in place.

Yet another object of the invention is to provide a clip-on shoehorn having an elongated handle extending upwardly from the blade whereby the user who grasps the handle is able to insert the blade into the shoe and clip it onto the counter of the shoe without having to bend down to carry out this operation.

A significant feature of the invention resides in a U-shaped blade of flexible material whose opposing flanks engage the sides of the shoe when the blade is inserted therein the flanks acting to spread out the sides of the shoe to enlarge the entry thereto.

A further object of this invention is to provide a clip-on shoehorn having tethered to its elongated handle a clasp which when the blade of the shoe horn is inserted in the shoe is then attachable to the tongue of the shoe to keep it away from the entry thereto while the foot is being slipped into the shoe.

Also an object of this invention is to provide a clip-on shoehorn of the above type which may be manufactured at low cost and which operates efficiently and reliably.

Briefly stated, these objects are attained by a clip-on shoehorn making it possible for an individual to slip his foot into a shoe despite a physical disability which impairs his ability to do so with the assistance of a conventional shoehorn.

The clip-on shoehorn is provided with a U-curved blade of flexible material whose opposing flanks engage and spread out the sides of the shoe when the blade is inserted therein whereby the blade enlarges the entry to the shoe and serves as a chute for the entering foot. Extending upwardly from the blade is an elongated handle, permitting the individual who grasps the handle to insert the blade into the shoe without having to bend down. Joined to the rear of the blade adjacent its upper end is a clip formed by a pair of superposed flexible strips which when the blade is inserted in the shoe then clamp onto the counter of the shoe to hold the blade in place.

Tethered to the upper end of the handle is a clasp that when the blade is inserted in the shoe is attachable to the tongue of the shoe to keep it away from the entry thereto while the foot is being slipped into the shoe.

BRIEF DESCRIPTION OF DRAWING

For a better understanding of the invention reference is made to the detailed description to follow which is to be read in conjunction with the accompanying drawing wherein:

FIG. 4 is a top view of the shoe when the blade of the shoehorn is inserted therein; and FIG. 5 is a side view of the shoe with the clip-on shoehorn applied thereto so that a foot may then be slipped into the shoe.

DESCRIPTION OF INVENTION

Structure of Clip-On Shoehorn

Figure 1:
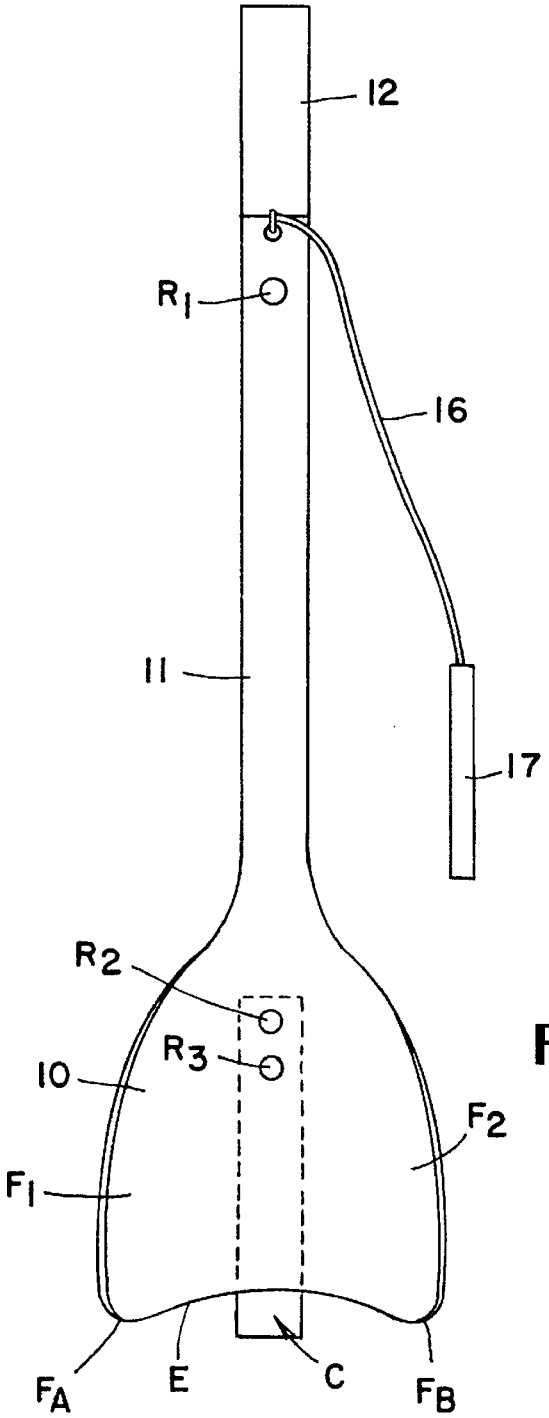
FIG. 1 is a front view of a clip-on shoehorn in accordance with the invention.
Figure 2:
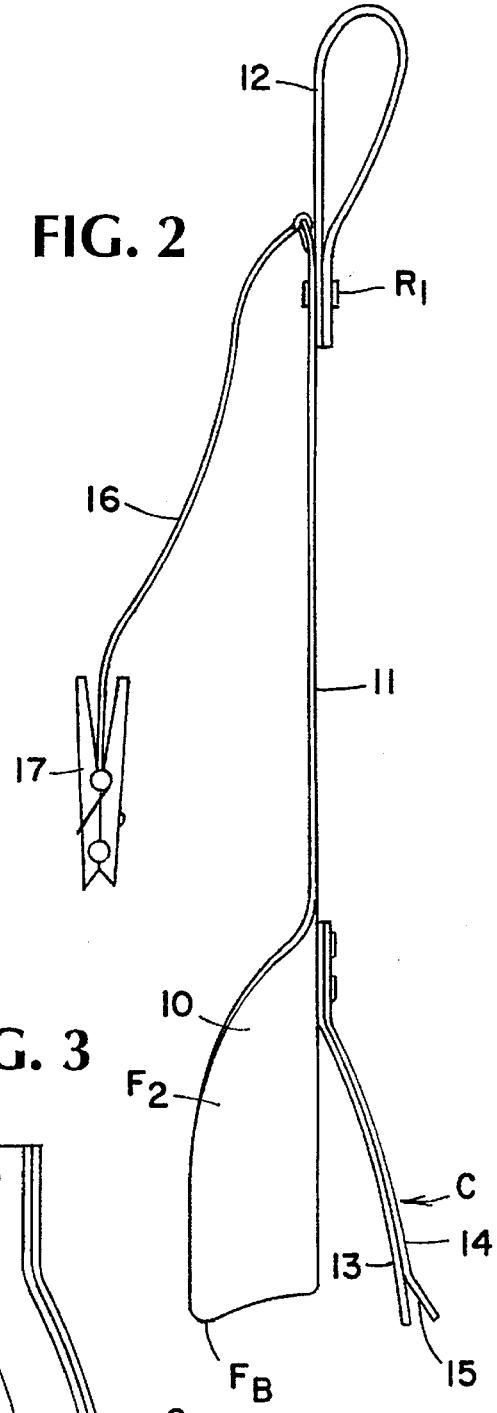
FIG. 2 is a side view of the clip-on shoehorn.

Referring now to FIGS. 1 and 2, there is shown a clip-on shoe-horn in accordance with the invention, the shoehorn including a blade 10 having a U-shaped curvature to define a chute provided with opposing flanks, $F_1$ and $F_2$. The lower edge E of the blade has an arcuate indentation extending between the flanks to define a pair of feet FA and FB at the lower extremities of the flanks.

Integral with blade 10 and extending upwardly from its center axis is an elongated flat handle 11 terminating in a loop 12 which is riveted to the handle by a metal rivet $R_1$. Blade 11, handle 11 and loop 12 are all molded or otherwise formed of flexible synthetic plastic material of high strength, such as polypropylene or polyethylene.

Figure 3:
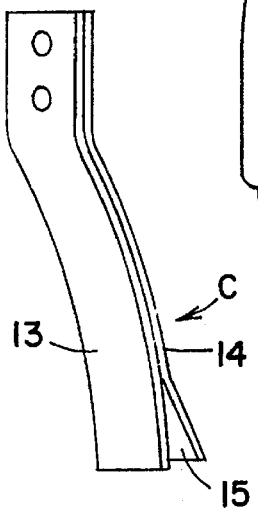
FIG. 3 is a separate view of the clip.

Attached by rivets $R_2$ and $R_3$ to the rear of the blade adjacent its upper edge is a clip C for clamping the blade onto the counter of the shoe in which it is inserted. As best seen in FIG. 3, clip C is formed by a pair of superposed strips 13 and 14 of flexible plastic material which may the same as that forming the blade. Strips 13 and 14 are angled away from the rear of the blade, the free end of outer strip 14 being flared to define an inlet 15 for the clip so that the clip when the blade is inserted in the shoe to be donned, the strips then sandwich and clamp onto the counter the shoe to hold the blade in place.

Tethered by a cord 16 to the upper end of handle 11 is a clasp 17 which preferably takes the form of a spring-biased alligator clip which is dilated by squeezing the clip. The function of clasp 17 is to clasp the tongue of the shoe and hold it away from the entry to the vacant shoe so that the tongue does not interfere with the insertion of the foot into the shoe interior.

The dimensions of blade 10 must, of course, be appropriate to the width of the shoe being donned. While a blade of a given size is suitable for most shoes, in special cases where the shoe width is extra small or extra large, the blade dimensions must be appropriate thereto.

Installation of the Shoehorn

In installing a clip-on shoe horn in accordance with the invention in a shoe 18, as shown in FIGS. 4 and 5, the user must grasp loop 12 of handle 11 and then insert blade 10 into the rear of the shoe adjacent its counter 19 so that the clip C then clamps onto the counter to hold the blade in place. Because of the length of the handle, the user who is sitting in a chair need not bend down to insert the blade into the shoe.

It will be seen in FIG. 5 that when clip C is clamped onto counter 19, blade 10 is then inclined with respect to the upright counter to create a chute for slipping the foot of the user into the shoe interior.

When curved blade 10 is inserted into the shoe, its flexible flanks $F_1$ and $F_2$, as best seen in FIG. 4 then press against the opposing sides 20 and 21 of the shoe and spread. them out to enlarge the entry into the shoe interior. And feet FA and FB on the bottom ends of the flanks then rest on the insole of the shoe so that the chute formed by the blade is stable.

When the blade of the shoehorn is in place, tethered clasp 17 is then attached to tongue 22 of the shoe to raise the tongue so that it does not block the entry into the shoe interior. At this point it is a simple matter for the user to slide his foot down the chute into the shoe interior, and then remove the shoehorn.

While there has been shown and disclosed a preferred embodiment of the clip-on shoehorn in accordance with the invention, it is to be understood that many changes may be made therein without departing from the spirit of the invention.

We claim:

1. A clip-on shoehorn making it possible for a user to slip his foot into a shoe having opposing sides leading to a rear counter havings two sides despite a physical handicap which impairs his ability to use a conventional shoehorn for this purpose; said clip-on shoehorn comprising:

A. a U-shaped curved blade of flexible material defining a chute;

B. a clip attached to said blade at its rear adjacent an upper edge of the blade said clip being outwardly inclined with respect to said blade and being formed by superposed flexible strips wherein when the blade is inserted in the shoe adjacent said counter, the strips then clamp onto both sides said counter to hold the blade in place; and C. an elongated handle extending upwardly from the upper edge of the blade whereby the user holding the handle can insert the blade into the shoe without the need to bend down.

2. A shoehorn as set forth in claim 1, in which the curved blade has a U-formation and is provided with opposing flanks that when the blade is inserted in the shoe engage and spread out the sides of the shoe to enlarge an entry thereto whereby the foot may be easily slipped therein.

3. A shoehorn as set forth in claim 1, in which the blade and the handle are formed of flexible synthetic plastic material.

4. A shoehorn as set forth in claim 2, in which a lower edge of the blade has an arcuate indentation which forms a pair of feet on the lower ends of the flanks.

5. A shoehorn as set forth in claim 3, in which the strips of the clip are formed of the same material as the blade.

6. A shoehorn as set forth in claim 1, further including a loop attached to the upper end of the handle.

7. A shoehorn as set forth in claim 1, further including a clasp tethered by a cord to the upper end of the handle for clasping a tongue of the shoe to hold it away from the entry into the shoe when the foot is slipped into the shoe.

* * * * *